United States Patent [19]

Ketteringham

[11] Patent Number: 4,961,288

[45] Date of Patent: Oct. 9, 1990

[54] APPARATUS FOR SHARPENING EDGE TOOLS

[75] Inventor: Thomas Ketteringham, Mevagissey, England

[73] Assignee: Martek Limited, Great Britain

[21] Appl. No.: 250,843

[22] Filed: Sep. 29, 1988

[51] Int. Cl.[5] ..... B24B 3/36

[52] U.S. Cl. ..... 51/92 BS; 51/102; 51/218 R; 51/231

[58] Field of Search ..... 51/91 R, 91 BS, 92 R, 51/92 BS, 102, 122, 128, 218 R, 231, 240 R, 285

[56] References Cited

U.S. PATENT DOCUMENTS

| | | | |
|---|---|---|---|
| 712,871 | 11/1902 | Walker | 51/122 |
| 1,915,247 | 6/1933 | Holloway et al. | 51/92 R |
| 2,008,943 | 7/1935 | Bodey | 51/92 R |
| 3,020,681 | 2/1962 | Hite | 51/122 |
| 3,879,899 | 4/1975 | Ribar | 51/92 BS |
| 3,883,995 | 5/1975 | Ohashi | 51/92 BS X |
| 4,259,814 | 4/1981 | Glaser et al. | 51/122 |
| 4,439,952 | 4/1984 | Roberts et al. | 51/231 X |

*Primary Examiner*—Robert A. Rose

*Attorney, Agent, or Firm*—Gifford, Groh, Sprinkle, Patmore and Anderson

[57] ABSTRACT

Apparatus for sharpening an edge tool having a linear cutting edge, such as a chisel, plane iron or gouge, comprises a rotary grindstone having a cylindrically curved surface mounted for rotation about an axis coincident with the axis of the cylinder, and tool mounting assembly on which an edge tool to be sharpened can be located, the tool mounting assembly including a guide assembly orientated such that relative movement between the tool and the rotary grindstone can take place substantially perpendicular to the plane including the point of contact between the edge tool and the stone and the axis of the grindstone. The tool mounting assembly includes a tool mount turnable about an axis orthogonal to the plane of a tool carried thereby, which is itself carried on a tool mount carrier turnable about an axis parallel to the axis of the rotary grindstone so that a tool to be sharpened can be positioned with its edge inclined to the axis of the grindstone but lying in a plane parallel to this axis and to the line of relative displacement between the tool mounting assembly and the grindstone.

11 Claims, 4 Drawing Sheets

APPARATUS FOR SHARPENING EDGE TOOLS

BACKGROUND OF THE INVENTION

It is well known that edge tools must be maintained in perfect condition in order to work satisfactorily, and although it is well realised that blunt tools are the cause of many accidents because they do not cut freely and properly, the sharpening of edge tools is nevertheless often neglected because of the high degree of skill involved in correctly performing this task. Recently, sharpening guides have become available, which hold the edge tool in a fixed orientation allowing it to be moved over a stationary stone to grind it to a correct shape, but such grinding operation is still laborious and time consuming. Edge tools having curved edges, such as gouges, are almost impossible for the amateur to sharpen properly. Hand-held edge tools are usually supplied by the manufacturer with the edge sharpened by grinding a flat bevel facet at 25° to the opposite major face of the tool, with the very edge of the tool being honed at 30° on a finer stone. Although large scale automatic machinery for grinding the bevel facet and honing the edge of a hand tool are known, equipment available for the owner of a set of hand tools to sharpen these is limited to two basic type the first of which is a guide for use on a stationary flat stone, which is both slow and subject to wear and the second of which is typically shown in British Patent No. 1293729, which describes a pair of rotary grindstones one at each end of a motor shaft in a configuration similar to a conventional bench grinder, in front of which is positioned a tool mount carried on a transverse guide bar extending parallel to the axis of rotation of the grindstones. An edge tool fitted on the mount can then be displaced across the cylindrical surface of one or other of the rotary grindstones and held rigidly in a predetermined orientation whilst being ground. This known tool has the disadvantage that, because it is passed over the cylindrical surface of the grindstone the facet ground on the bevel edge of the tool is concavely curved to form a so-called hollow ground face, which weakens the very edge of the tool and allows it to become blunt more rapidly than a flat edge. There is also the possibility that a variation in pressure applied by the user as the edge tool is traversed across the grindstone will result in differing amounts of material being removed from the edge of the tool at different transverse positions so that a straight true edge is not guaranteed, especially for wider tools such as plane irons. In an attempt to overcome this problem the tool holder described in European Patent application No. 225806 incorporates a stop member for limiting the rotation of a tool holder about a tool guide formed as a cylindrical bar, but this tool too provides a bevel facet which is hollow ground and, furthermore, involves considerably complexity in the tool mount.

OBJECTS OF THE INVENTION

A previous object of the present invention is to provide a fast, efficient, accurate and simple apparatus for sharpening an edge tool which is easy to use and which has a wide range of application.

Another object of the present invention is to provide apparatus for sharpening an edge tool which is suitable for both professional and amateur alike whilst being of reasonable cost.

A further object of the present invention is to provide apparatus for sharpening edge tools having both straight and curved cutting edges.

SUMMARY OF THE INVENTION

According to the present invention, there is provided apparatus for sharpening an edge tool having a linear cutting edge, such as a chisel, a plane iron or a gouge, comprising a rotary grinding stone having a cylindrically curved surface mounted for rotation about an axis coincident with the axis of the cylinder and tool mounting means on which an edge tool to be sharpened can be located, the tool mounting means including guide means oriented such that relative movement between the tool and the rotary grinding stone can take place substantially perpendicular to the plane including the point of contact between the edge tool and the stone and the axis of the grindstone.

By providing this arrangement, in which the relative movement of the stone and the tool being sharpened is orthogonally located with respect to that employed in known tool sharpening machines it is possible to make use of a relatively small stone whilst nevertheless being able to sharpen edge tools such as chisels and plane irons the length of the cutting edges of which are very substantially different from one another.

Preferably the tool mounting means of the present apparatus includes means for retaining an edge tool in a selectable determined orientation with respect to the axis of rotation of the rotary grinding stone. This enables not only the honed edge, but also a relief angle to be ground on a tool. It is known, for example, that chisels are usually ground to an angle of 25° to the plane of the flat face of the tool, with a narrow strip along the cutting edge being honed to an angle in the region of 30°. The apparatus of the present invention makes it possible for both ground faces to be formed easily and quickly.

Preferably the tool mounting means is adjustable such that the inclination of the edge of an edge tool to be sharpened with respect to the line of relative movement between the tool mounting means and the rotary grindstone is adjustable over a range of inclination with the said edge lying in a plane parallel to both the axis of rotation of the grindstone and the line of relative movement between the tool mounting means and the grindstone.

The tool mounting means preferably include a tool mount which can be fitted to an underlying support in one of two pre-determined orientations whereby to select one of two angles at which the edge of the tool is to be ground. This adjustment can also be used, as will be explained in more detail below, to select when an internal or external edge is formed on a curved tool such as a gouge. It will be appreciated that gouges are formed in two types, both having basically a cylindrically curved steel body, but one type having a bevel edge cut on the convex or outer face at the end of the body whilst the other type has a bevel edge formed on the concave or inner face thereof. Such gouges are used for cutting internal and external curves respectively, for example when producing parallel flutes or other decorative work.

The path of relative movement between the edge tool to be sharpened and the rotary grinding stone may be substantially rectilinear, as in the case of chisels and plane irons, but may be made curvilinear by adaptation using an adapter to allow sharpening of curved-edge tools, such as gouges.

Different embodiments of the invention may be provided with different arrangements for driving the rotary movement of the stone. For example, the rotary grindstone may be mounted on bearings fixedly located within a casing of the apparatus and the relative movement between the tool to be sharpened and the rotary grindstone effected by displacement of the tool along a determined path with respect to the casing and thus with respect to the rotary grindstone. Alternatively, however, the tool could be held stationary on the casing and the stone arranged to be movable with respect thereto, such movement being effected by lateral translation of the stone spindle perpendicular to its length. Such movement would necessarily need to be linear or curved in a plane including the line of the cutting edge (in the case of a rectilinear cutting edge) or curved to match the curve of the cutting edge (in the case of a curvilinear cutting edge).

The rotary grindstone is conveniently mounted on a spindle of a spindle assembly driven by a motor carried within the casing of the apparatus, and the motor may be fixedly located or mounted so as to be movable with the stone. Alternatively, the rotary grindstone may be mounted on a freely rotatable spindle assembly having an input end which projects from the casing of the apparatus for attachment to a removably attachable drive motor such as a hand held pistol drill.

To achieve this end the spindle assembly preferably incudes a grindstone spindle on which the rotary grindstone is mounted, a drive input spindle lying at an angle to the grindstone spindle, and a bevel gear transmission linking the two for transmission of rotary motion from the drive input spindle to the grindstone spindle. To simplify manufacturing processes this arrangement can also be used in embodiments having an integral motor, with the bevel gear being turned through 90° such that the input shaft lies parallel to the casing wall rather than perpendicular thereto as in the case of the embodiment intended for connection to an external motor.

The tool mounting means of the apparatus of the present invention may comprise a tool mount turnable about an axis perpendicular to the plane of a tool mount face thereof and a tool mount carrier turnable about an axis parallel to the axis of the grindstone. In such an arrangement it is possible that the tool mount and tool mount carrier are interconnected so that angular displacement of the tool mount carrier about its axis is associated with related angular displacement of the tool mount about its axis with respect to the tool mount carrier in such a way that one edge of the tool mount always lies in a plane parallel to both the axis of rotation of the grindstone and the line of displacement of the tool mount assembly along the rectilinear guide means.

The tool mounting means may include a support body displaceable parallel to the said guide and a tool carrier which is displaceable with respect to the support body in a direction perpendicular to the rectilinear guide. The tool carrier may itself likewise be formed in two parts, a first part permanently fitted to the support body and displaceable with respect thereto as a carriage in the said perpendicular direction, and a second part or tool mount removably attachable to the carriage and interchangeable with similar such tool mounts adapted for receiving different tools to be sharpened.

In a preferred embodiment of the present invention the said rectilinear guide means is formed as a pair of parallel rods mounted fixedly on the casing with a predetermined spacing therebetween, and the support body is slidable therealong. Such sliding contact may be provided by means of plain bearings, or by rolling element bearings in a backlash-free configuration, such as a recirculating ball bearing. Alternatively, the rectilinear guide may be in the form of a V-block receiving contact members of an appropriate carriage.

The rectilinear guide means may include means for varying the inclination of a tool mount about an axis parallel to the length of the rectilinear guide means whereby to adjust the angle at which a bevel facet at the edge of the tool is ground.

Preferably the said support body is formed with or carries rectilinear guide means for the tool carrier to guide the said tool carrier in the said perpendicular direction to advance a tool carried thereby towards a line of intersection with the grindstone whereby to determine the amount of material removed in a pass of the tool and grindstone upon relative movement therebetween. The said support body and the tool carrier are conveniently interlinked by screw threaded motion control means operable to cause such relative movement between them with a controllable fine adjustment of the relative positions thereof whereby to set the amount of material removed from the tool in such a pass between the tool mounting means and the grindstone upon relative movement between them.

The interconnection between the tool mount and the carriage of the tool carrier may be formed, as in the preferred embodiment, by means of a projection on the or each tool mount, which projection has a dovetail cross-section which can be introduced into a groove of complementary dovetail cross-section in the said carriage. One of these two preferably has clamping means for securing them together when the dovetail projection has been fitted into the dovetail groove.

Different tool mounts may be shaped specifically to receive different kinds of tools. For example, the tool mount may have at least one substantially flat face for locating a correspondingly flat face of a tool to be sharpened. This flat face may be inclined with respect to the dovetail projection and there may be provided a second dovetail projection at a different angle from that of the first so that the inclined face can be presented in one of two inclinations whereby to offer the edge tool at one or the other of two different inclinations to the grindstone. For a different tool, such as gouge, the tool mount may have a convexly curved bicuspid curvature to receive a cylindrically curved surface of a tool to be sharpened, allowing relative movement thereof with respect to the said tool carrier about an axis coincident with that of the said cylindrically curved surface of the tool to be sharpened.

Whatever the form of the tool mount there are preferably provided retainer means for retaining a tool to be sharpened with a face thereof in contact with a face of the tool mount. Such retainer means may comprise an arm projecting from the tool mount with a lateral finger projecting therefrom whereby partly to encircle the tool to be sharpened and draw it into contact with the said one face of the tool mount. Other forms of retainer may, alternatively, be employed.

As an addition, the casing may further include a housing for a substantially flat stationary grindstone against which a tool can be worked for cleaning of any burrs produced by the rotary grindstone in use of the apparatus. The rotary grindstone is preferably made of an abrasive laminate, and it has been found that a cloth/abrasive laminate is of particular utility. Alternatively, however, often abrasive materials may be employed, such as a plasma sprayed ceramic on a metal base having a grit-blasted surface.

Other features and advantages of the present invention will become appararent from a study of the following detailed description in which reference is made to the accompanying drawings, provided purely by way of non-limitative example only.

DESCRIPTION OF THE PREFERRED EMBODIMENTS

Figure 1:
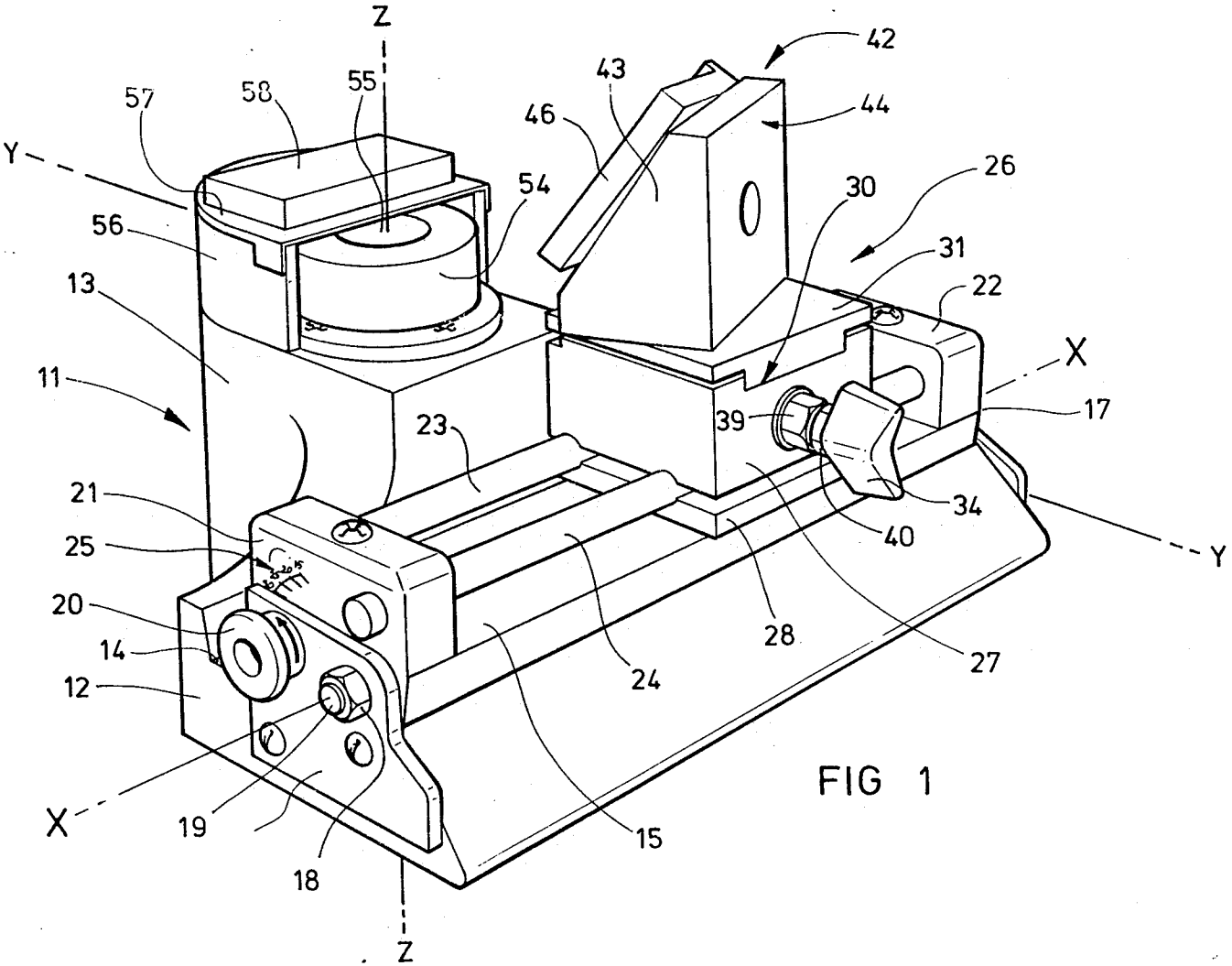
FIG. 1 is a perspective view of the first embodiment of the invention seen from the front.
Figure 2:
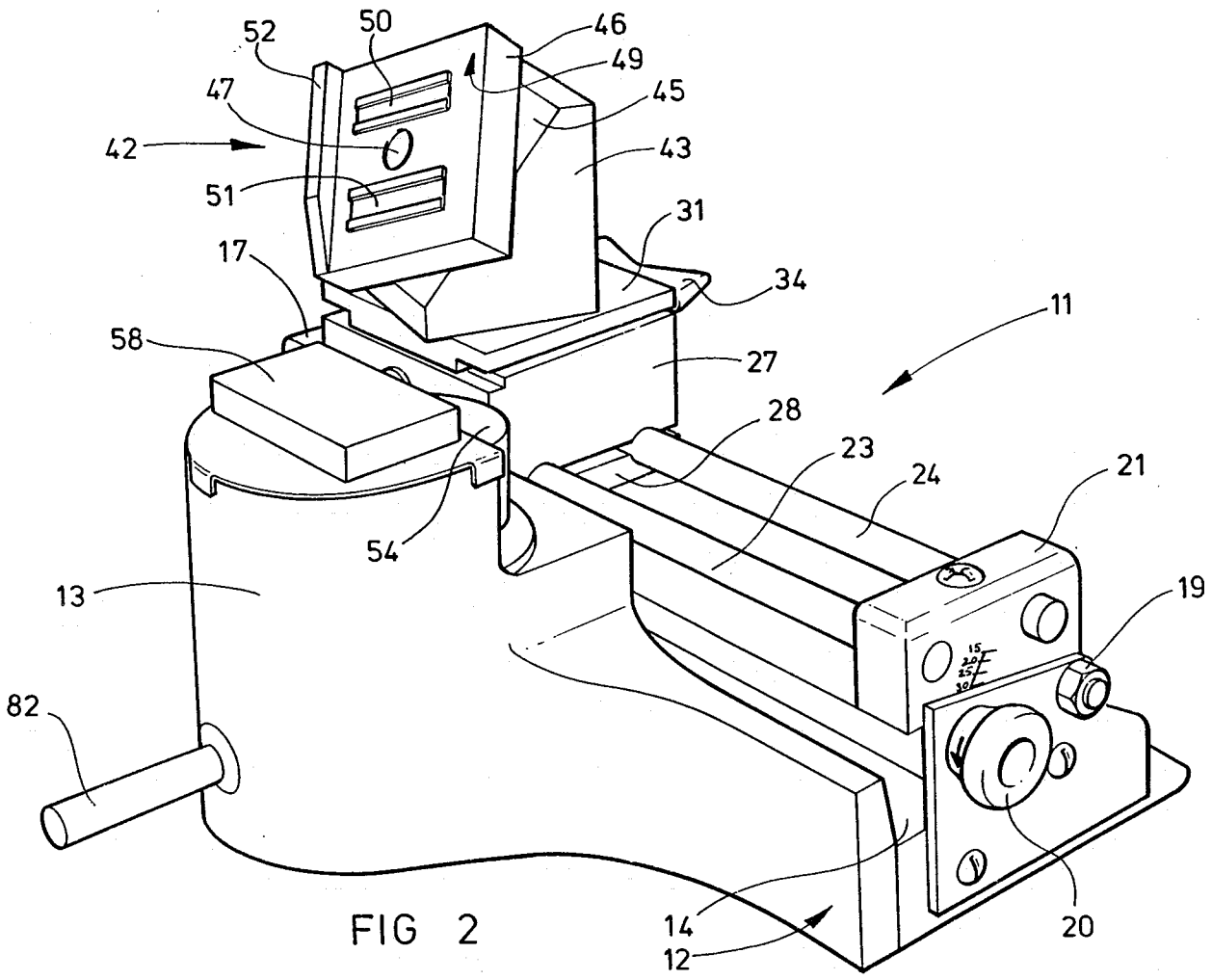
FIG. 2 is a perspective view of the embodiment of FIG. 1 seen from the rear.

The apparatus shown in FIG. 1 of the drawings comprises a casing generally indicated 11 having a slide body part 12 and a stone support part 13. The slide body part 12 has an inclined upper face 14 over which is positioned a guide rail support base 15 which is carried at each end by upwardly projecting lateral supports 16, 17 secured at each end of the slide body part 12 of the casing. The guide rail support base 15 is pivoted to turn about a horizontal axis X—X which coincides with the pivotal attachment of the guide rail support base 15 to the lateral supports 16 and 17, which is evidenced in FIGS. 1 and 2 by the attachment nut 18 which secures a pivot 19.

The lateral supports 16, 17 each have an arcuate slot (not shown) through which passes a threaded pin attached to the guide rail support base 15 and on to which is screwed a clamp wheel 20. A similar clamp wheel is positioned in relation to the lateral support 17, but is not visible in the drawings.

At each end of the guide rail support base 15 are two guide rail support blocks 21, 22 in which are secured two parallel guide rails 23, 24. On one of the guide rail support blocks, namely the block 21, there is marked a scale of graduations generally indicated with the referenced numeral 25, which can be reference against the upper edge of the lateral support 16 to determine the angular position of the plane defined by the two guide rails 23, 24 in relation to the slide body part 12 of the casing for reasons which will be described in more detail below.

Slidably carried on the parallel rails 23, 24 is a tool mount carriage generally indicated 26, which comprises a main carriage body 27 beneath which is secured a reaction plate 28. The main carriage body 27 and the reaction plate 28 have respective parallel part cylindrical grooves in which the guide rails 23, 24 are received and the reaction plate 28 is biased, with respect to the main carriage body 27 by means of a biasing spring 29 which can be seen in FIG. 4. Adjustment screws (not shown) determine the force applied between the reaction plate 28 and the main carriage body 27 so that the frictional resistance experienced by the tool mount carriage 26 as it is displaced along the guide rails 23, 24 can be adjusted. Conveniently the main carriage body 27 and reaction plate 28 are made from a plastics material having a relatively low coefficient of friction, whilst the guide rails 23, 24 may be made from a metal or other material which can be highly polished so that, again, there is a low frictional resistance between the rails and the tool mount carriage as this is displaced to and fro along the guide rails.

Figure 4:
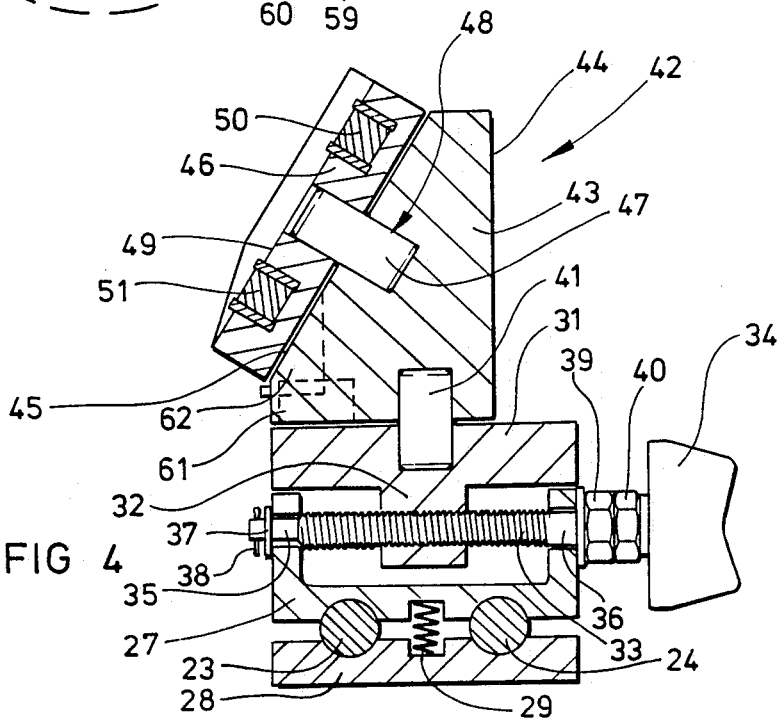
FIG. 4 is a cross-section through the tool mount taken on the line IV—IV of FIG. 1.

The main carriage body 37 has a recess 30 in its upper face to form a guide for a transverse slide member 31 which, as can be seen in FIG. 4, has a downwardly projecting threaded boss 32 engaged by a threaded shaft 33 on one end of which is a butterfly knob 34. The shaft 33 is threaded only along its intermediate section and has plain bearings 35, 36 at each end and is restrained from axial movement by a washer 37 and lock pin 38 at one end, and by a pair of lock nuts 39, 40 at the other. By turning the butterfly knob 34, therefore, linear displacement of the transverse slide member 31 can be achieved in a direction transverse the length of the guide rails 23, 24.

In the upper face of the transverse slide member 31 is a socket receiving a stud 41 which is a tight fit therein and which may be secured in position, for example by adhesives. The stud 41 serves as a locating peg and pivot for a tool mount assembly generally indicated 42 and comprising a tool mount carrier 43 which has a vertical rear face 44 and an inclined front face 45. Pivotally mounted to the front face 45 of the tool mount carrier 43 is the tool mount itself, indicated with the reference numeral 46, which has a generally planar configuration and a central rearwardly projecting spigot 47 received in a correspondingly shaped socket 48 in the inclined face 45 of the tool mount carrier 43. The tool mount 46 has a flat front face 49 in which are housed two permanent magnets 50, 51 for retaining a metal tool such as a chisel or plane iron in position when engaged thereon. At one side of the tool mount 46 is an upstanding shoulder 52 which serves as a locating abutment for one side of a tool 53 when positioned with its major face flat against the flat front face 49 of the tool mount 46, in which position it will be retained by the permanent magnets 50 and 51.

The stone support part 13 of the casing carries a vertical spindle (not shown) on the upper end of which is secured a rotary grindstone 54 of the so-called "cup" type having a central recess 55 in its upper circular flat face through which access can be gained to a nut securing the stone 54 on the upper end of the spindle. For reasons which will be explained in more detail below the spindle itself may have an axial threaded hole at one end as well as an externally threaded portion for receiving the securing nut which retains the stone 54 in position. The stone support part 13 of the casing 11 includes a semi-cylindrical shroud 56 which encloses the stone 54 over approximately one half of its circumference and the shroud 56 is provided with a removable cover 57 carrying a stationary fine slip stone 58.

Figure 3:
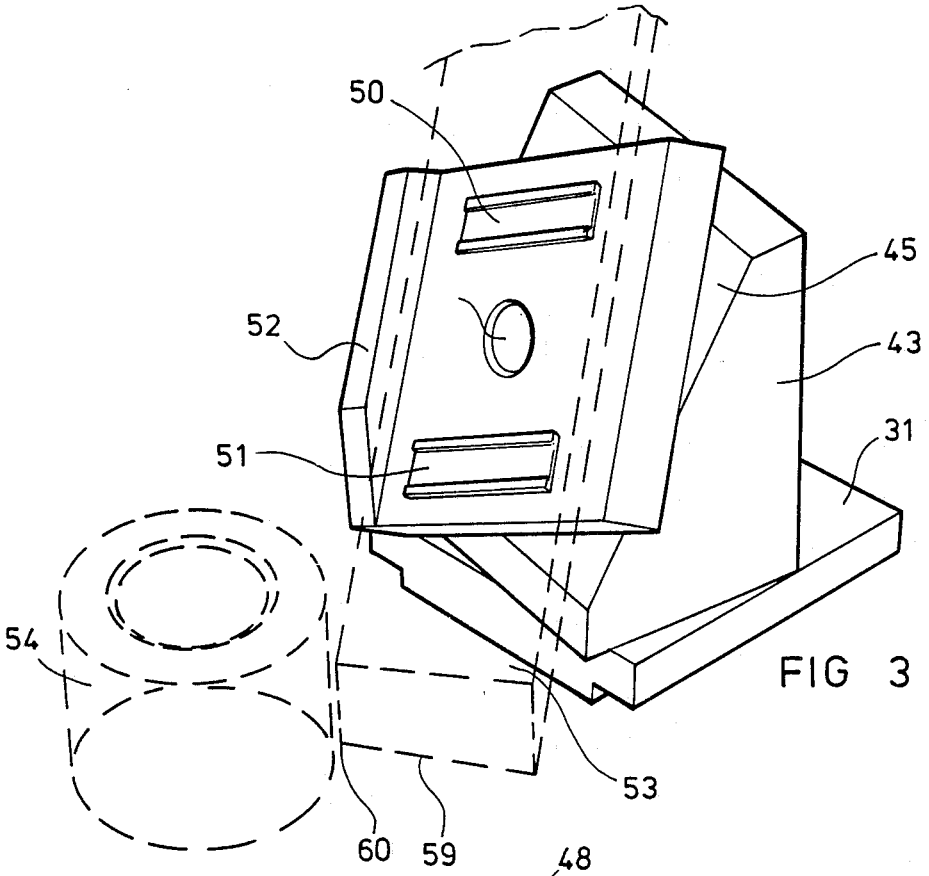
FIG. 3 is an enlarged perspective view of the tool mount of the embodiment of FIG. 1.

In use of the embodiment described above a tool such as the chisel 53 illustrated in broken outline in FIG. 3, is positioned on the flat front face 49 of the tool mount 46 so that its edge 59 is closely adjacent the cylindrical surface of the rotary grindstone 54. By turning the tool mount 46 about the axis defined by the spigot 47 the edge 59 of the tool 53 can be inclined so that is occupies a vertical distance corresponding to the axial dimension of the stone 54. However, since the axis defined by the spigot 47 is inclined to the axis of rotation of the stone 54 this movement will, when viewed in plan, leave the edge 59 of the tool at an inclination to the line of travel of the tool mount carriage 26 on the guide rails 23, 24 so that as the carriage 26 is displaced to and fro along the guide rails 23, 24 only the proximal corner 60 of the edge 59 of the tool 53 will come into contact with the grindstone 54. To compensate for this, therefore, the tool mount body is turned about the vertical axis defined by the stud 41 until the edge 59 is again parallel to the line defined by the guide rails 23, 24. These two movements may be made entirely independently, as in the embodiment illustrated, leaving the operator to judge the precise position of the tool mount carrier 43 and the tool mount 46 to establish the correct alignment of the edge 59 of the tool or, as illustrated in broken outline in FIG. 4, a mechanical interlink may be provided, for example in the form of a meshing arcuate rack 61 on the transverse slide member 31, projecting upwardly into a correspondingly shaped recess (not shown) in the tool mount carrier 43 and a meshing toothed partial pinion 62 mounted on or integrally formed as part of the tool mount 46. With such an arrangement rotation of the tool mount carrier 43 about the vertical axis defined by the stud 41 will automatically result in rotation of the tool mount 46 about the axis defined by the spigot 47 due to the meshing interengagement of the arcuate rack 61 and the toothed partial pinion 62. Suitable dimensions and positioning of these two components 61, 62 will ensure that the angular displacement of the tool mount 46 is related in the correct proportion to the angular displacement of the tool mount carrier 43. The degree of inclination required will depend on the length of the edge 59 of the tool to be sharpened with the intention that it should contact the whole of the axial width of the cylindrical surface of the stone 54 as the tool edge is traversed past the stone. A relatively narrow chisel, for example, will require a significant inclination in order to achieve this effect whereas a wider plane iron would require only a small inclination. By inclining the edge 59 in this way it is ensured that even wear on the stone 54 takes place thereby minimising the localisation of wear points and extending the life of the stone between successive dressings. Dressing of the stone can be achieved, of course, by placing an appropriate dressing stone against one edge of the shroud 56 which, being parallel to the axis of rotation of the stone 54, acts as a suitable restraint and guide for such dressing.

Figure 7:
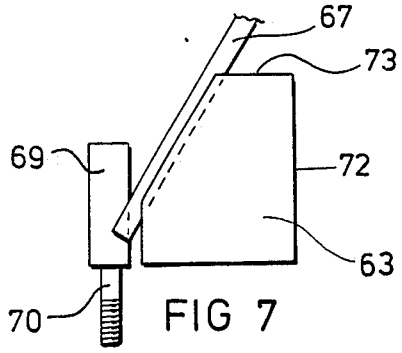
FIG. 7 is a side view illustrating one way in which the tool mount of FIG. 5 can be set up for grinding an internally bevelled gouge.
Figure 5:
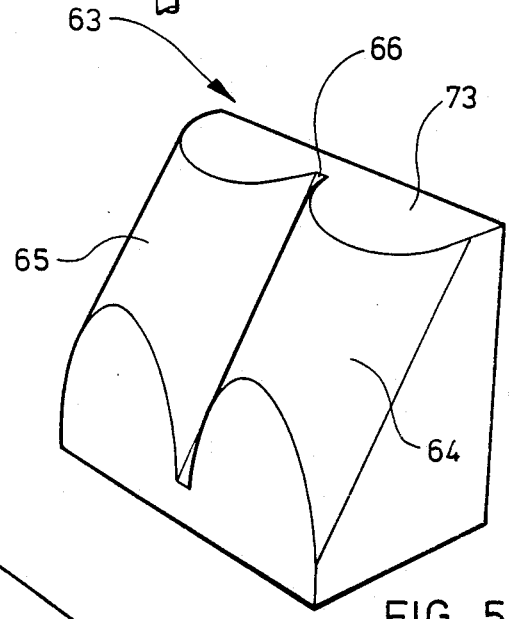
FIG. 5 is a perspective view of an alternative tool mount different from that illustrated in FIGS. 3 and 4.

Turning now to FIG. 5, an alternative tool mount 63 is illustrated, which is adapted to be fitted onto the stud 41 projecting up from the transverse slide member 31. The tool mount 63 is adapted for sharpening gouges, and for this purpose is provided with two part cylindrical parallel surfaces 64, 65 spaced by a rectilinear groove 66 parallel to the inclined front face 45 of the corresponding tool mount carrier 43. An appropriate socket is formed in the lower face of the gouge tool mount 63 to enable it to be fitted to the upper face of the transverse slide member 31 onto the stud 41, although in this case rotation of the tool mount 63 about the axis defined by the stud 41 is not required and a suitable shoulder or lip for engaging over one edge of the transverse slide 31 may be provided. In use of this embodiment a gouge 67 is positioned with its convexly curved surface in contact with the two convex part cylindrical surfaces 64, 65 and lying parallel to the groove 66. In this position the mount supports the tool in such a way that the reaction lines of force between the mount 63 and the tool itself meet at the centre of curvature of the tool so that laterally applied forces, providing they maintain the tool in contact with the bicuspid surfaces 64, 65, cause the tool to perform a rotation about its centre of curvature. This ensures that the edge of a gouge is caused to follow a curve parallel to that of the intersection between its bevel edge and its convex cylindrical surface thereby causing it to be sharpened against the grindstone 54 providing this latter has a smaller radius of curvature than that of the tool. If the stone 54 has too greater a radius of curvature it can be replaced with a small diameter stone 69 having a threaded shank 70 as shown in FIG. 7, which can be screwed into the upper end of the spindle on which the stone 54 is mounted (after having removed the stone 54 itself).

Figure 8:
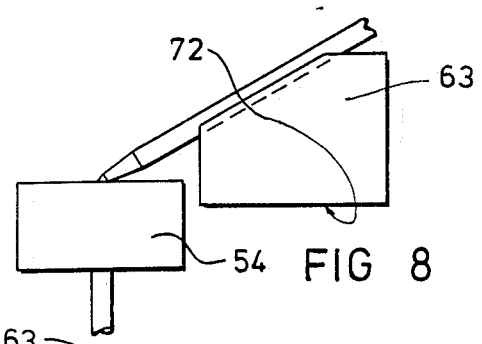
FIG. 8 is a side view illustrating a second configuration in which the tool mount of FIG. 5 can be set for grinding an externally bevelled gouge.

In order to sharpen a gouge having an external bevel the mount 63 is removed from the cross slide 31 and repositioned in the orientation illustrated in FIG. 8. The inclined biscuspid faces 64, 65 now lie at a much shallower angle to the horizontal and a gouge positioned thereon can be brought into contact with the upper circular face of the grindstone 54 instead of the cylindrically curved surface which is used for grinding an inside bevel edge. The tool operates in the same way with the bicuspid surfaces 64, 65 causing the tool to be turned about its centre of curvature when displaced laterally whilst remaining in contact with the two curves of the bicuspid surfaces 64, 65.

The approach of the tool to be sharpened to the stone 54 or the stone 69 can be controlled by turning the butterfly knob 34 to cause relative approach or withdrawal of the transverse slide 31. When sharpening a gouge 67, of course, it is not intended that the tool mount carriage 26 shall be displaced along the guide rails 23, 24.

Figure 6:
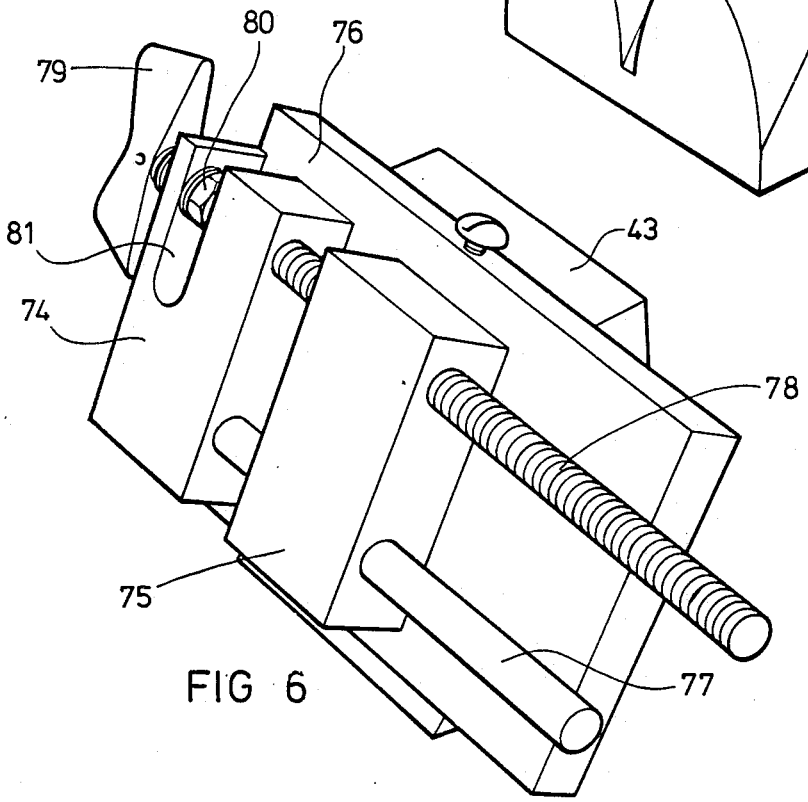
FIG. 6 is a perspective view of a further alternative tool mount.

In FIG. 6, an alternative tool mount assembly is shown in which, in place of the permanent magnets 50, 51 for retaining a metal tool, there is provided a clamp comprising two parallel jaws 74, 75 the first of which is fixed to an inclined support plate 76 carried fixedly on the front face of a tool mount body in all respects similar to the tool mount 43. Two parallel guides 77, 78, the latter of which is threaded, traverse the jaws 74, 75 and the threaded guide 78 carries a butterfly knob 79 for making adjustments to the separation of the jaws 74, 75. The threaded guide 78 is retained against displacement with respect to the fixed jaw 74 by a lock nut arrangement 80 housed in a groove 81 of the fixed jaw 74. A tool mount such as this may be considered more suitable for a wide tool such as a plane iron which can thereby be secured with a greater degree of security onto the tool mount than would be the case relying solely on the magnets 50, 51.

The stone 54 may be driven to rotate about its axis by an electric motor housed within the stone support part 13 of the casing 11, or may alternatively be provided with bevel gears (not shown) linking it to a drive spindle 82 which can be gripped by, for example, the chuck of a pistol drill. Instead of bevel gears a belt drive may be employed.

The inclination of the bevel edge ground at the end of the tool 53 can be determined by appropriately setting the guide rail support base 15 after having slackened the clamp wheel 20, and the angle of the bevel can be read by reference to the scale of graduations 25 against the top edge of the lateral support 16. As illustrated the edge may be ground at anything between 15° and 30°. Although conventional chisels are ground only at 25° and/or 30° it is envisaged that the sharpening machine of the present invention will be capable of sharpening any edge tool, in particular turning and carving chisels which are of various shapes and have edges inclined to the length of the tool at an angle other than 90°. Appropriate adjustment of the tool mount and the guide rail support base will present the edge of the tool to be sharpened at an appropriate angle so that, upon traversing the carriage 26 along the guide rails 23, 24 an appropriate edge will be formed at the end of the tool.

Fine finishing of the edge by hand may be achieved, if desired, by stroking the sharpened tool on the stationary slip stone 58 carried on the cover 57 over the shroud 56. By appropriately choosing the material for the stone 54, however, it is envisaged that such finishing operations will rarely be required.

What is claimed is:

1. Apparatus for sharpening an edge tool having a linear cutting edge, comprising:

a rotary grinding stone having a cylindrically curved surface, means mounting said rotary grinding stone for rotation about an axis coincident with the axis of said cylindrically curved surface, and tool mounting means including:

guide means for guiding relative movement between said edge tool to be sharpened and said rotary grinding stone, said guide means guiding said relative movement between said edge tool and said rotary grinding stone to lie in a displacement plane which is substantially perpendicular to the plane including the point of contact between said edge tool and said rotary grinding stone and the axis of rotation of said rotary grinding stone, a tool mount having a tool mount face and being turnable about an axis perpendicular to the plane of said tool mount face, and a tool mount carrier turnable about an axis parallel to said axis of rotation of said rotary grindstone, said tool mount and said tool mount carrier being connected together so that angular displacement of said tool mount carrier about its axis is associated with related angular displacement of said tool mount about its axis with respect to said tool mount carrier in such a way that one edge of said tool mount always lies in a plane parallel to said displacement plane.

2. The apparatus of claim 1, wherein said tool mounting means includes means for retaining an edge tool in a selectable determined orientation with respect to said axis of rotation of said rotary grinding stone.

3. The apparatus of claim 2, wherein said tool mounting means is adjustable such that the inclination of the edge of an edge tool to be sharpened is adjustable with respect to said displacement plane whereby to adjust the angle of the edge ground on the said edge tool by the said apparatus.

4. The apparatus of claim 1, wherein said guide means define a rectilinear path of relative movement between said tool mounting means for said edge tool to be sharpened and said rotary grindstone.

5. The apparatus of claim 1, wherein said apparatus is encased in a casing and said rotary grindstone is mounted on a freely rotatable spindle assembly having an input end which projects from said casing of said apparatus for attachment to a removably attachable drive motor of a pistol drill.

6. The apparatus of claim 5, wherein said spindle assembly includes a grindstone spindle on which said rotary grindstone is mounted.

a drive input spindle lying at an angle to said grindstone spindle, and a bevel gear transmission linking said two spindles for transmission of rotary motion from said drive input spindle to said grindstone spindle.

7. The apparatus of claim 1, wherein said tool mounting means include:

a slide member displaceable in a direction perpendicular to said rectilinear guides.

8. The apparatus of claim 7, wherein said slide member is provided with engagement means operating to retain said tool mount carrier whilst permitting angular displacement thereof about an axis parallel to said axis of rotation of said rotary grindstone.

9. The apparatus of claim 1, wherein said guide means is formed as a pair of parallel rods mounted fixedly on a casing of said apparatus with a predetermined spacing therebetween, and said tool mount is slidable therealong.

10. Apparatus for sharpening an edge tool having a linear cutting edge, comprising:

a rotary grinding stone having a cylindrically curved surface, means mounting said rotary grinding stone for rotation about an axis coincident with the axis of said cylindrically curved surface, and tool mounting means including a tool mount for locating a tool to be sharpened, and guide means for guiding relative movement between said edge tool to be sharpened and said rotary grinding stone, said guide means guiding said relative movement between said edge tool and said rotary grinding stone to lie in a displacement plane which is substantially perpendicular to the plane including the point of contact between said edge tool and said rotary grinding stone and the axis of rotation of said rotary grinding stone, and said tool mount being adjustable about two inclined axes less than 90° to one another, one of which is parallel to the axis of said rotary grinding stone, whereby adjustments to the position of the edge tool carried thereby can be made to locate the edge of the tool in a plane parallel to the said displacement plane and at an inclination such that the projection of the edge parallel to the axis of rotation of the grinding stone is shorter in length than the axial length of the grinding stone itself.

11. The apparatus of claim 10, wherein said guide means include means for varying the inclination of said tool mount about an axis parallel to the length of said guide means whereby to adjust the angle at which a bevel facet at the edge of a said tool to be sharpened is ground.

* * * * *